United States Patent [19]

Hight

[11] 4,227,315

[45] Oct. 14, 1980

[54] CLOTHES DRYER HEAT ECONOMIZER

[76] Inventor: Jesse G. Hight, 313 Augustus, St. Marys, Ohio 45885

[21] Appl. No.: 913,594

[22] Filed: Jun. 8, 1978

[51] Int. Cl.[3] ..... F26B 11/04

[52] U.S. Cl. ..... 34/82; 34/86; 34/133; 55/410; 55/518

[58] Field of Search ..... 34/82, 86, 90, 133, 34/89; 220/345, 346, 200; 55/410, 432, 518

[56] References Cited

U.S. PATENT DOCUMENTS

| | | | |
|---|---|---|---|
| 2,891,693 | 6/1959 | Fosburgh | 220/345 |
| 3,486,309 | 12/1969 | Wild | 55/432 |
| 3,639,998 | 2/1972 | Mason | 34/82 |
| 3,673,701 | 7/1972 | Albertson | 34/90 |
| 3,999,304 | 12/1976 | Doty | 34/86 |
| 4,011,662 | 3/1977 | Davis et al. | 34/86 |
| 4,034,482 | 7/1977 | Briscoe | 34/90 |
| 4,095,349 | 6/1978 | Parker | 34/86 |
| 4,137,647 | 2/1979 | Clark, Jr. | 34/82 |

FOREIGN PATENT DOCUMENTS

| | | | |
|---|---|---|---|
| 3665 | of 1883 | United Kingdom | 220/346 |

*Primary Examiner*—Larry J. Schwartz
*Attorney, Agent, or Firm*—Eugene G. Botz

[57] ABSTRACT

A filter unit for use with a clothes dryer for filtering the exhaust and selectively directing the exhaust to the outside or inside of a building. The filter unit supports a filter element in a slanted position so that when installed between the studdings of a building the filter unit does not extend an appreciable amount beyond the surface of the wall and still provides for large capacity filtering. A removable cover makes for easy access to the filter element. The filter housing is made of sheet material which has reinforced walls. An indicator is used for indicating the condition of the filter element.

2 Claims, 4 Drawing Figures

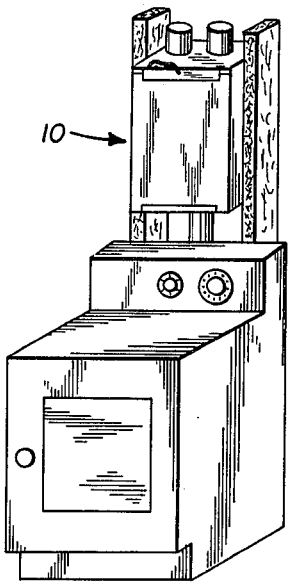
FIG. 2
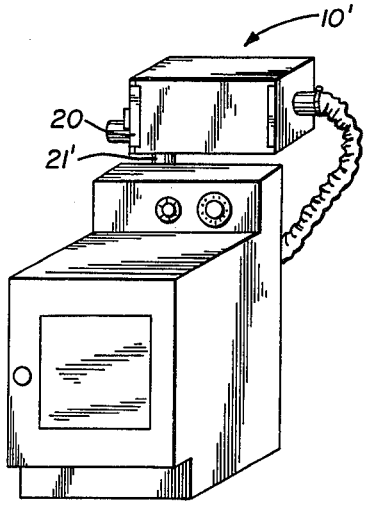
FIG. 3
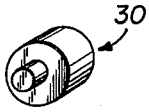
FIG. 4
FIG. 1
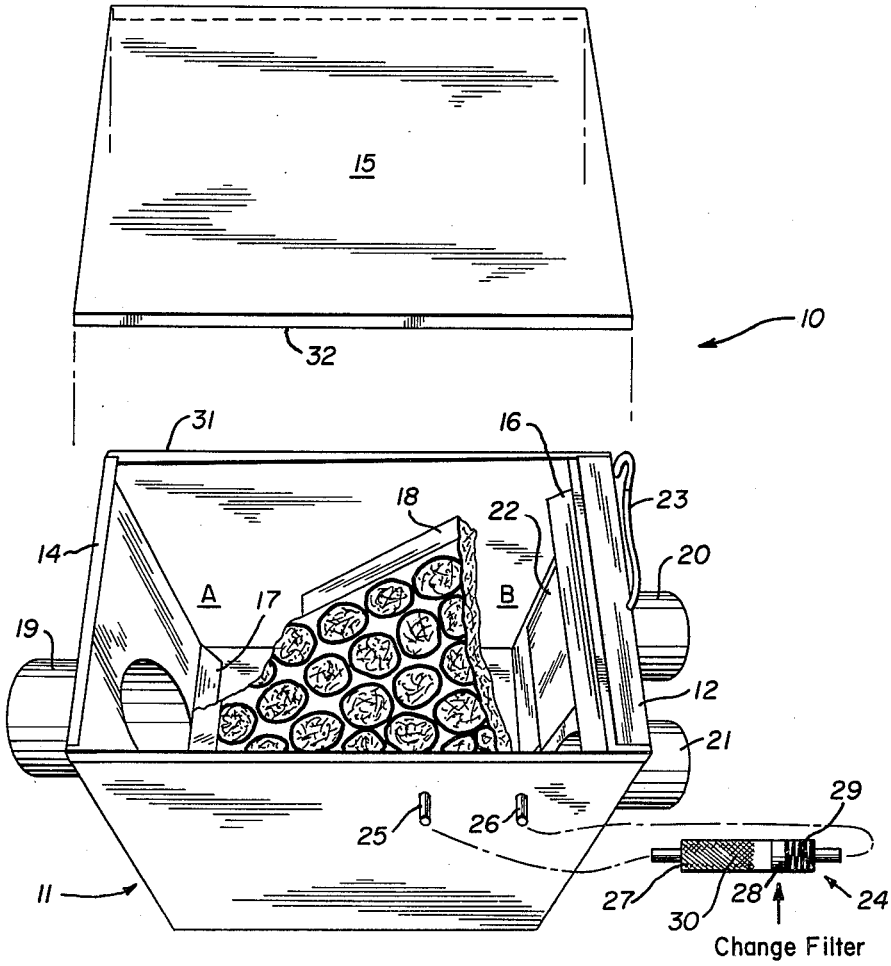

CLOTHES DRYER HEAT ECONOMIZER

The prior art describe arrangements for using exhaust from a clothes dryer to add warm moist air to a building during cold weather. The prior arrangements use a filter to remove lint from the exhaust before it is discharged into the building.

It is an object of this invention to provide a filter for use with a clothes dryer which filter is of large capacity and therefore requires less attention.

Another object of this invention is to provide a slant supported filter element which although of large capacity may be located between the framework or studdings of a building and when installed does not extend an appreciable amount beyond the surface of the wall.

A further object of this invention provides a door for easy access to the filter element.

Another still further object is the provision of a hose adaptor so that the filter unit may be used to supply warm dry air external to the attached dryer and also may be used in cleaning the exhaust outlet and related parts of an attached clothes dryer.

Other objects and advantages will become apparent in the following specification when considered in the light of the attached drawings, in which:

FIG. 1 is a view of the filter unit with its cover removed.

FIG. 2 is a view of the filter unit installed in conjunction with a conventional clothes dryer.

FIG. 3 shows the filter unit altered so that it may be installed directly above the conventional clothes dryer.

FIG. 4 is a view of an adaptor.

Referring now to the drawing, numeral 10 designates the filter unit. It is constructed of a five sided rectangular housing 11 with an open top. The housing 11 has a width which will allow it to be installed between the studdings of a building. The open top is closed by a rectangular shaped cover 15. In order to form an air tight housing the cover is held in position by two flanges 12 and 14. Flange 14 is wide enough to retain cover 15 and flange 12 not only retains the lid but allows the cover to slide into the flange so that the lid may clear flange 14 and be removed from the housing. See FIG. 2 which shows the cover 15 in place and extending about half-way up into the top flange 12. The cover is removed by moving it up further into flange 12 until the lower end of the cover clears the bottom flange 14. The lower end of the cover is pulled away from the housing 11 and its upper end removed from under flange 12. The sides not supporting the flanges are formed with out-turned lips 31 in order to reinforce the box. Likewise, the cover has down-turned lips 32 which when the cover is on the housing the lips of the cover are in snug contact with the lips of the housing.

The filter element 18 is a conventional rigid rectangular frame with the filter material therein, which may be of the permanent washable type or of the disposable type. The filter element 18 is wide enough so as to form a snug fit with the inside walls of the housing.

Supports 16 and 17 support the filter element 18 in a slanted position. Support 16 is an angle piece located at the top of the housing and support 17 is a flat piece located at the opposite lower end of the housing.

The filter element 18 divides the housing into chambers A and B. Duct 19 is attached to the filter unit and when connected to the exhaust of a clothes dryer conducts the exhaust into chamber A. Ducts 20 and 21 allow exhaust of air from filter unit 10. One of the ducts 20 or 21 is chosen to connect chamber B to the outside of a building and the other may be used to add warm moist air to the inside of a building.

A damper 22 has a flap or valve adapted to close ducts 20 or 21 depending upon the position of lever 23. As shown in the drawing, lever 23 is made of a rod-like material. At the end of lever 23 opposite to the end attached to the valve a hook-like portion is formed causing the lever to be pressed against the housing. The hook-like portion is allowed to press down past the end of the housing 11, locking the valve in position.

An indicator 24 is connected to the filter unit. Two pipes 25 and 26 attached to the side of the filter unit open into chambers A and B, respectively. By means of tubing these pipes are connected to opposite ends of indicator 24. Thus the indicator 24 will show the condition of the filter element 18 as the pressure difference across the filter element 18 increases.

Indicator 24 may take the form of a transparent tube 27 enclosing a piston 28 which is spring (29) loaded towards the end of the tube 27 attached to chamber A. The tube 27 is partially opaque (30). When the piston appears in the clear portion of the tube 27 it is an indication that the filter element should be changed.

The filter unit shown in FIG. 3 has been modified so that duct 21' is located in the side of filter unit 10' and the damper 22 rearranged so that it will function to alternatively close ducts 20 or 21'.

When adaptor 30, illustrated in FIG. 4, is inserted into duct 21 or 20 and a hose attached, warm dry air may be used for drying purposes external to the clothes dryer. Of course, clothes are not being dryed when the adaptor is in use.

The filter unit's construction makes for easy cleaning of the outlet passage and related parts of an attached clothes dryer. This cleaning is accomplished by inserting the hose of a vacuum cleaner into duct 19 and the exhaust passage of the attached clothes dryer. If so desired, the adaptor 30 with the cleaning hose attached may be inserted into duct 19.

What I claim is:

1. A filter unit for use with a clothes dryer comprising a five sided housing with an open top, a cover having down-turned portions for closing said top, opposite sides of said open top having out-turned portions for receiving said down-turned portions of said cover, flange means on the top of said housing for retaining said cover on said housing, supports located at the far opposite ends of the housing for supporting a filter element in a slanting position, said filter element and housing forming first and second chambers, a second means adapted for connecting the exhaust of a clothes dryer to said first chamber, third and fourth means connected to said second chamber for conducting air from said second chamber, fifth means for alternatively closing said third or fourth means.

2. A filter unit according to claim 1 wherein said unit is adapted to be inserted between the framework of a building and said slanted filter element forms a large filter surface with a minimum depth which approximates the depth of said framework.

* * * * *